US007665445B2

(12) United States Patent
Venkataraghavan et al.

(10) Patent No.: US 7,665,445 B2
(45) Date of Patent: Feb. 23, 2010

(54) MOTION COUPLER FOR A PIEZOELECTRIC ACTUATOR

(75) Inventors: Jayaraman Krishnapura Venkataraghavan, Dunlap, IL (US); Shriprasad Gaurishankar Lakhapati, Peoria, IL (US); Stephen Robert Lewis, Chillicothe, IL (US); Avinash Reddy Manubolu, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 5 days.

(21) Appl. No.: 12/081,643

(22) Filed: Apr. 18, 2008

(65) Prior Publication Data

US 2009/0260599 A1 Oct. 22, 2009

(51) Int. Cl.
*F02M 37/04* (2006.01)
*F02M 51/00* (2006.01)

(52) U.S. Cl. ..... 123/498; 239/585.1

(58) Field of Classification Search ..... 123/498; 239/585.1–585.5

See application file for complete search history.

(56) References Cited

U.S. PATENT DOCUMENTS 4,720,077 A 1/1988 Minoura et al.
4,975,615 A 12/1990 Katahara
5,740,969 A 4/1998 Hoffmann et al.
6,260,541 B1 * 7/2001 Ricci-Ottati et al. ..... 123/498
6,299,074 B1 * 10/2001 Cooke ..... 239/102.2
6,422,482 B1 7/2002 Stier et al.
6,499,471 B2 12/2002 Shen et al.
6,715,695 B2 * 4/2004 Lorraine ..... 239/102.2
6,840,466 B2 1/2005 Igashira et al.
6,883,725 B2 4/2005 Hohl et al.
6,889,913 B2 5/2005 Ruehle et al.
6,948,667 B2 * 9/2005 Eichendorf ..... 239/585.1
7,145,282 B2 12/2006 Oakley et al.
7,276,837 B2 10/2007 Boecking
7,282,839 B2 10/2007 Mochizuki et al.
7,290,530 B2 * 11/2007 Boecking ..... 123/467
2002/0117560 A1 * 8/2002 Igashira et al. ..... 239/585.1
2005/0056706 A1 3/2005 Crofts
2006/0196975 A1 9/2006 Magel et al.
2006/0219805 A1 10/2006 Boecking
2007/0096375 A1 5/2007 Stier et al.
2008/0217440 A1 * 9/2008 Mochizuki et al. ..... 239/585.5

* cited by examiner

*Primary Examiner*—Thomas N Moulis
(74) *Attorney, Agent, or Firm*—Finnegan, Henderson, Farabow, Garrett & Dunner

(57) ABSTRACT

The present disclosure is directed to a fuel injector. The fuel injector may include a casing substantially aligned along a central axis of the fuel injector. The fuel injector may also include a control valve configured to control a flow of fuel through the fuel injector. The fuel injector may also include a piezoelectric element disposed within the casing and associated with the control valve. The fuel injector may further include a motion coupler disposed between the control valve and the piezoelectric element the motion coupler configured to affect shock to reduce microscopic fractures within the piezoelectric element.

22 Claims, 4 Drawing Sheets

MOTION COUPLER FOR A PIEZOELECTRIC ACTUATOR

TECHNICAL FIELD

The present disclosure relates generally to piezoelectric actuators and, more particularly to a motion coupler for a piezoelectrically actuated fuel injector.

BACKGROUND

Fuel injection systems typically employ multiple fuel injectors to deliver injections of high pressure fuel into an engine for combustion. Each fuel injector typically includes a nozzle assembly having a pressurized chamber configured to contain a volume of pressurized fuel. During an injection, the volume of pressurized fuel is expelled through an orifice within the nozzle assembly. Typically, injectors also include a needle valve element that is slidably disposed within the pressurized chamber. The needle valve element may be biased by a spring towards a closed position where the orifice is blocked. To inject fuel, the needle valve element is selectively moved to unblock the orifice, thereby allowing high pressure fuel to flow from the pressurized chamber, through the orifice, and into the engine.

Selective movement of the needle valve element may be controlled by a control valve and a control chamber. The control chamber may be selectively filled and drained of pressurized fuel. When the control chamber is full of pressurized fuel, the fuel may act on a hydraulic surface of the needle valve element and bias the needle valve element into the closed position, thereby closing the injector. To open the injector, a piezoelectric actuator may move the control valve and release the pressurized fuel within the control chamber into a drain. Depressurization of the control chamber causes a change in the bias of the needle valve element and, therefore, encourages the needle valve element to move into the unblocked position. The piezoelectric actuator typically consists of a piezoelectric stack having multiple layers of piezoelectric material separated by electrically conductive layers that act as electrodes. When an electrical potential is applied across the electrically conductive layers, the piezoelectric stack expands longitudinally. The longitudinal expansion provides the motion necessary to move the control valve and depressurize the control chamber. Although this configuration may be effective for initiating the injection of fuel, the piezoelectric stack is brittle and may crack if it is overloaded.

One method utilized by injector manufacturers to isolate the piezoelectric stack from damaging forces is described in U.S. Pat. No. 7,145,282 (the '282 patent) issued to Oakley et al. The '282 patent describes a fuel injector for an internal combustion engine, including a piezoelectric actuator having a piezoelectric stack isolated within a casing. The casing is rigid and is designed to absorb shear stresses. Further, the case is configured to place a preload on the piezoelectric stack. which may protect the piezoelectric stack by keeping the piezoelectric stack in compression even when tensional forces are acting on the actuator.

Although the piezoelectric actuator of the '282 patent may be protected from shear forces and tensional forces, it may still not be sufficiently isolated. For example, the piezoelectric actuator may expand rapidly to open the valve, and after fully opening the valve, the actuator may hit a hard stop. That is, the actuator may overextend and may collide with a rigid stop when the valve reaches a fully open position. Each time the piezoelectric stack hits the hard stop microscopic cracks may form therein and, after repeatedly hitting the hard stop, the device may fail due to fatigue.

The fuel injector of the present disclosure is directed to one or more of the shortcomings set forth above and/or other shortcomings in the art.

SUMMARY

In one aspect, the present disclosure is directed to a fuel injector. The fuel injector may include a casing substantially aligned along a central axis of the fuel injector. The fuel injector may also include a control valve configured to control a flow of fuel through the fuel injector. The fuel injector may also include a piezoelectric element disposed within the casing and associated with the control valve. The fuel injector may further include a motion coupler disposed between the control valve and the piezoelectric element the motion coupler configured to affect shock to reduce microscopic fractures within the piezoelectric element.

In another aspect, the present disclosure is directed to a fuel injector. The fuel injector may include a casing substantially aligned along a central axis of the fuel injector and a piezoelectric element disposed within the casing and configured to expand a first distance along the central axis. The fuel injector may also include a control element configured to move a second distance and affect a flow of fuel through the fuel injector, the second distance not equal to the first distance. The fuel injector may further include a piston slidably disposed between the piezoelectric element and the control element the piston configured to transfer motion from the piezoelectric stack to the control element.

In still another aspect, the present disclosure is directed to a method of injecting fuel. The method of injecting fuel may include pressurizing fuel, selectively energizing a piezoelectric element to translate a first distance and reducing shock within the piezoelectric element. Additionally, the method may include translating a piston a second distance to cause a flow of pressurized fuel to be injected, the second distance having a magnitude that is less than the magnitude of the first distance.

DETAILED DESCRIPTION

Figure 1:
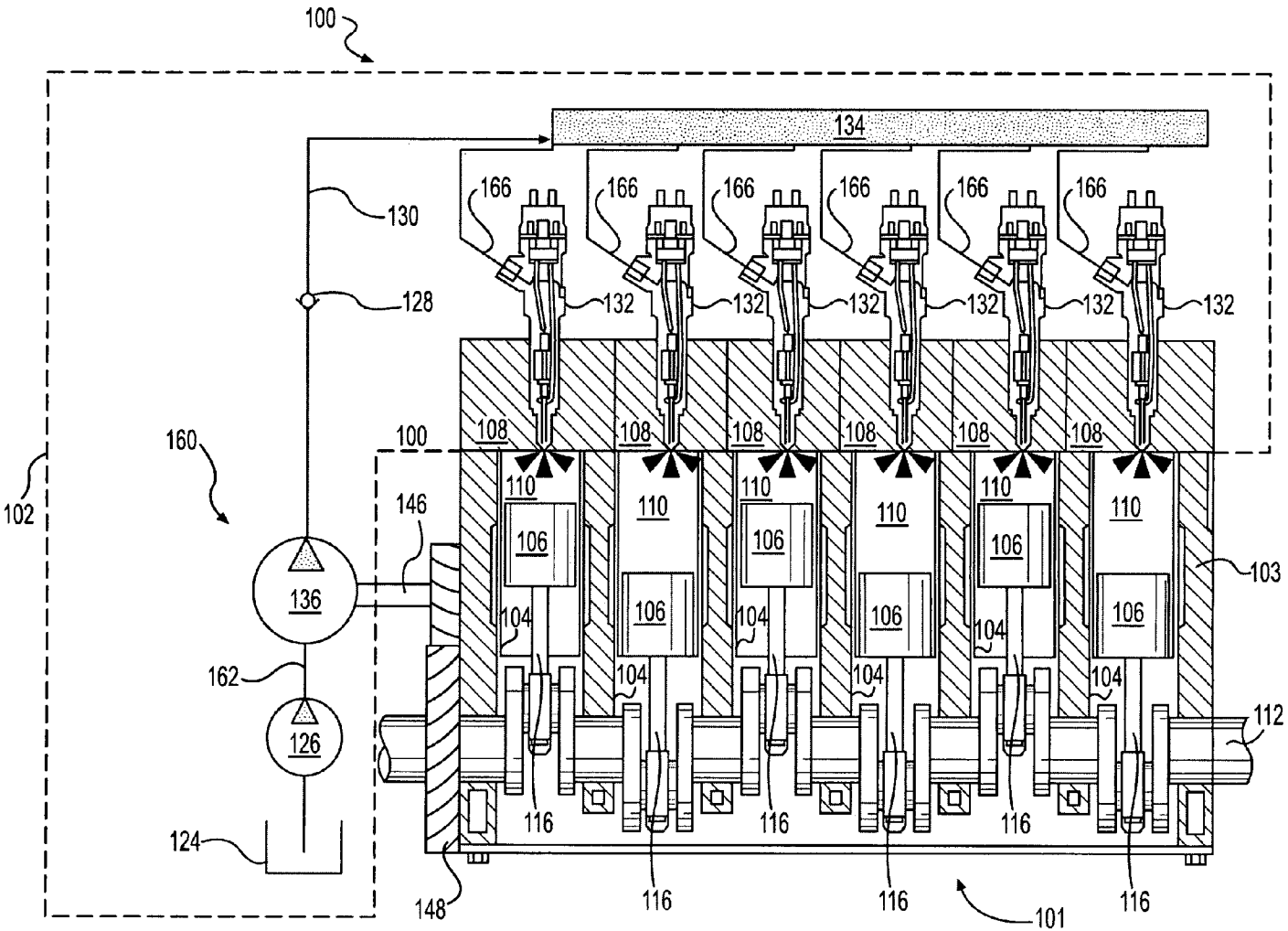
FIG. 1 is a diagrammatic illustration of an exemplary disclosed engine.

FIG. 1 illustrates an exemplary power system 100. Exemplary power system 100 may include an engine 101 and a fuel injection system 102. Engine 101 may be configured to produce a rotational output and may be used to power a machine (not shown). The machine may be a fixed machine or may be a mobile machine that performs some type of operation associated with industry such as mining, construction, farming, power generation, transportation or any other industry known in the art. For example, the machine may embody an earth moving machine such as an off-highway haul truck, a wheel loader, a motor grader, or any other operation-performing machine.

As shown in the embodiment of FIG. 1, engine 101 may be a four stroke internal combustion diesel engine. One skilled in the art will recognize, however, that engine 101 may embody any other type of internal combustion engine, such as, for example, a gasoline engine, or a gaseous fuel-powered engine. Engine 101 may include an engine block 103 that defines a plurality of cylinders 104. A piston 106 may be slidably disposed within each cylinder 104, and each cylinder 104 may be associated with a cylinder head 108.

Cylinder 104, piston 106, and cylinder head 108 may form a combustion chamber 110. In the illustrated embodiment of FIG. 1, engine 101 includes six combustion chambers 110. However, it is contemplated that engine 101 may include a greater or lesser number of combustion chambers 110 and that combustion chambers 110 may be disposed in an "in-line" configuration or a "v" configuration or any other configuration apparent to one skilled in the art.

Also shown in FIG. 1, engine 101 may include a crankshaft 112 that is rotatably disposed within engine block 103. A connecting rod 116 may connect each piston 106 to crankshaft 112 so that a sliding motion or motions of piston 106 within each respective cylinder 104 may result in a rotation of crankshaft 112. Similarly, a rotation of crankshaft 112 may result in a sliding motion or motions of piston 106.

Fuel-injection system 102 may include components that cooperate to deliver injections of pressurized fuel into each combustion chamber 110. Specifically, fuel injection system 102 may include a tank 124 configured to hold a supply of fuel, and a pumping arrangement 160 configured to pressurize the fuel and direct the pressurized fuel to a plurality of fuel injectors 132 by way of an injection manifold 134.

Fuel pumping arrangement 160 may include one or more pumping devices that function to increase the pressure of the fuel and direct a flow of pressurized fuel to injection manifold 134. In one example, fuel pumping arrangement 160 includes a low pressure pump 126 and a high pressure pump 136 disposed in series and fluidly connected by way of a fuel line 162. Low pressure pump 126 may be a transfer pump configured to provide low pressure feed to high pressure pump 136. High pressure pump 136 may be connected to injection manifold 134 by way of a fuel line 130. A check valve 128 may be disposed within fuel line 130 to provide for a one-directional flow of pressurized fuel from fuel pumping arrangement 160 to injection manifold 134.

Low pressure pump 126 and/or high pressure pump 136 may be operably connected to engine 101 and driven by crankshaft 112. Low pressure pump 126 and/or high pressure pump 136 may be connected to crankshaft 112 in any manner apparent to one skilled in the art where a rotation of crankshaft 112 will result in a corresponding rotation of a pump drive shaft 146. For example, pump drive shaft 146 of high pressure pump 136 is shown in FIG. 1 as being connected to crankshaft 112 through a gear train 148. It is contemplated, however, that low pressure pump 126 and/or high pressure pump 136 may alternatively be driven electrically, hydraulically, pneumatically, or in any other appropriate manner.

One fuel injector 132 may be disposed within each cylinder 104. Each fuel injector 132 may be operable to deliver injections of pressurized fuel from injection manifold 134 into an associated combustion chamber 110 via fuel line 166 at predetermined timings, fuel pressures, and fuel flow rates. The timing of fuel injections into combustion chambers 110 may be synchronized with the motion of piston 106. For example, pressurized fuel may be injected as piston 106 nears a top-dead-center position in a compression stroke to allow for compression ignited combustion of the delivered fuel. Alternatively, fuel may be injected as piston 106 begins the compression stroke heading towards top-dead-center for homogenous charge compression ignition operation. Additionally, fuel may be injected as piston 106 is moving from the top-dead-center position during an expansion stroke for a late post injection.

Figure 2:
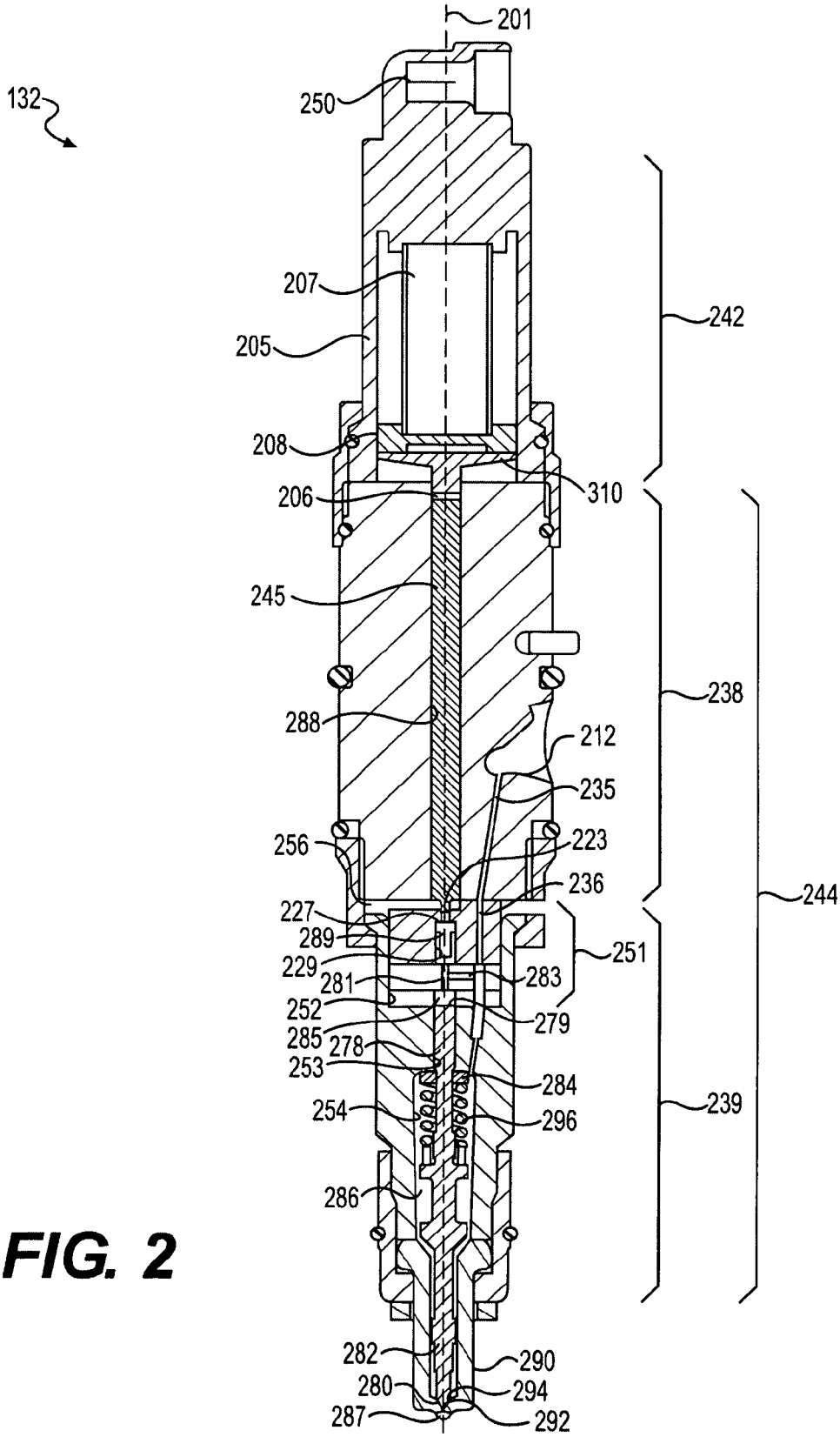
FIG. 2 is a diagrammatic illustration of an exemplary fuel injector for use with the engine of FIG. 1.

As illustrated in FIG. 2, each fuel injector 132 may be a closed nozzle unit fuel injector 132. Specifically, each fuel injector 132 may include a housing 205, a nozzle 290, an injector assembly 244, and an actuation assembly 242. Actuation assembly 242 may be energized by an electrical current and may actuate longitudinally to cause a change in displacement within injector assembly 244. The displacement caused by actuation assembly 242 may allow a flow of pressurized fuel to be delivered from injection manifold 134 (FIG. 1) through nozzle 290 and into combustion chamber 110 (FIG. 1).

Housing 205 may be generally cylindrical and may be disposed around a central axis 201. Housing 205 may be configured to enclose various components of actuation assembly 242 and may be coupled with injector assembly 244. It is contemplated that central axis 201 may run longitudinally through housing 205, injector assembly 244 and nozzle 290.

Nozzle 290 may also be a generally cylindrical member and may be coupled with injector assembly 244. Further, nozzle 290 may have an internal nozzle bore 292 and may be configured to accept a bottom end 282 of a needle valve element 278. Bottom end 282 may seat at a needle valve element seating surface 294 and, when seated, may substantially block a flow of fuel through an injection orifice 287. Alternatively, when the bottom end 282 is not seated, fuel injector 132 may deliver the flow of pressurized fuel through injection orifice 287 and into combustion chamber 110 (FIG. 1) from injector assembly 244.

Injector assembly 244 may also be a generally cylindrical member and as shown in FIG. 2, injector assembly 244 may have an upper assembly 238 and a lower assembly 239. Upper assembly 238 may be disposed between lower assembly 239 and actuation assembly 242. Upper assembly 238 and lower assembly 239 may work together to affect the injection of pressurized fuel from injection manifold 134 (FIG. 1) to combustion chamber 110 (FIG. 1) of engine 101 (FIG. 1).

Upper assembly 238 may be supplied with fuel from injection manifold 134 at a fuel inlet port 212. The fuel may be communicated from upper assembly 238 to lower assembly 239 through an upper fuel supply passageway 235. In addition to fuel inlet port 212 and upper fuel supply passageway 235, upper assembly 238 may also include an upper piston 245 slidably disposed within an upper bore 288. Upper piston 245 may be configured to translate within upper bore 288 in reaction to the displacement caused by actuation assembly 242.

Lower assembly 239 may be coupled with nozzle 290 and may include various components that work together to deliver pressurized fuel through nozzle 290. Specifically, lower assembly 239 may include a control valve 251 and needle valve element 278. Control valve 251 may regulate the flow of pressurized fuel to control the movement of needle valve element 278.

Control valve 251 may be disposed within a control bore 252 of lower assembly 239. Further, control valve 251 may include various cavities and components to control the movement of needle valve element 278. Specifically, control valve 251 may include a check top volume 285, a balance orifice 281, and a drain passageway 256.

Check top volume 285 may be supplied with fuel from a lower fuel supply passageway 236 through balance orifice 281. Pressurized fuel moving into check top volume 285 through balance orifice 281 may cause the bottom end 282 of needle valve element 278 to settle against needle valve element seating surface 294. Additionally, the flow of pressurized fuel may also move through a control orifice 283 and cause a control element 289 to settle against an upper seat 227. Control element 289 may be slidably disposed within an internal bore 229 and may be movable by a tip 223 of upper piston 245 to control the flow of pressurized fuel out of check top volume 285. That is, actuation assembly 242 may, upon being energized, cause upper piston 245 to move control element 289 off of its upper seat 227 thereby allowing the flow of pressurized fuel to move from check top volume 285 into drain passageway 256. It is contemplated that balance orifice 281 may be relatively more narrow than lower fuel supply passageway 236 to allow for a momentary drop in pressure within check top volume 285.

Needle valve element 278 may be disposed, at least partially, within control bore 252 and may come into contact with control valve 251. Also, needle valve element 278 may also be disposed, at least partially, within a central bore 253 and a lower bore 254. Further, control bore 252 and lower bore 254 may be connected by central bore 253.

Needle valve element 278 may be an elongated cylindrical member that is slidably disposed within internal bore 252, central bore 253, lower bore 254, and nozzle 290. Needle valve element 278 may be axially movable between a first position and a second position. In the first position, bottom end 282 of needle valve element 278 blocks the flow of pressurized fuel through an injection orifice 287. In the second position, injection orifice 287 may be open to allow the flow of pressurized fuel to be injected into combustion chamber 110.

Needle valve element 278 may be normally biased toward the first position. In particular, as seen in FIG. 2, each fuel injector 132 may include a return spring 296 disposed between a stop 284 and needle valve element seating surface 294 of needle valve element 278 to axially bias bottom end 282 toward first position. It is contemplated that needle valve element 278 may have multiple driving hydraulic surfaces. That is, needle valve element 278 may have surfaces designed to bias needle valve element 278 in response to forces applied by pressurized fuel. In particular, needle valve element 278 may include a first hydraulic surface 279 tending to drive needle valve element 278 toward the first position when acted upon by pressurized fuel, and a second hydraulic surface 280 that tends to oppose the bias of return spring 296 and drive needle valve element 278 in the opposite direction toward the second position. First hydraulic surface 279 and second hydraulic surface 280 may cause needle valve element 278 to move between the first position and the second position depending on a pressure gradient between check top volume 285 and control chamber 286.

Actuation assembly 242 may be disposed opposite of nozzle 290 and may indirectly control the movement of needle valve element 278. Actuation assembly 242 may include a hermetically sealed assembly 207, an engagement device 208, and, optionally, a motion coupler 310. Hermetically sealed assembly 207 may be configured to receive electrical energy from an electrical terminal 250 and use the electrical energy to generate a displacement. The displacement may be transmitted from hermetically sealed assembly 207 to engagement device 208, from engagement device 208 to motion coupler 310, and from motion coupler 310 across a gap 206, to upper piston 245. Gap 206 may exist between motion coupler 310 and upper piston 245. Gap 206 may provide space for expansion, particularly thermal expansion. However, gap 206 may also provide space for parts that may be within the manufacturing tolerances but may be slightly larger than designed. In one embodiment, the gap 206 may be five microns, but could be between one micron and ten microns.

Figure 3:
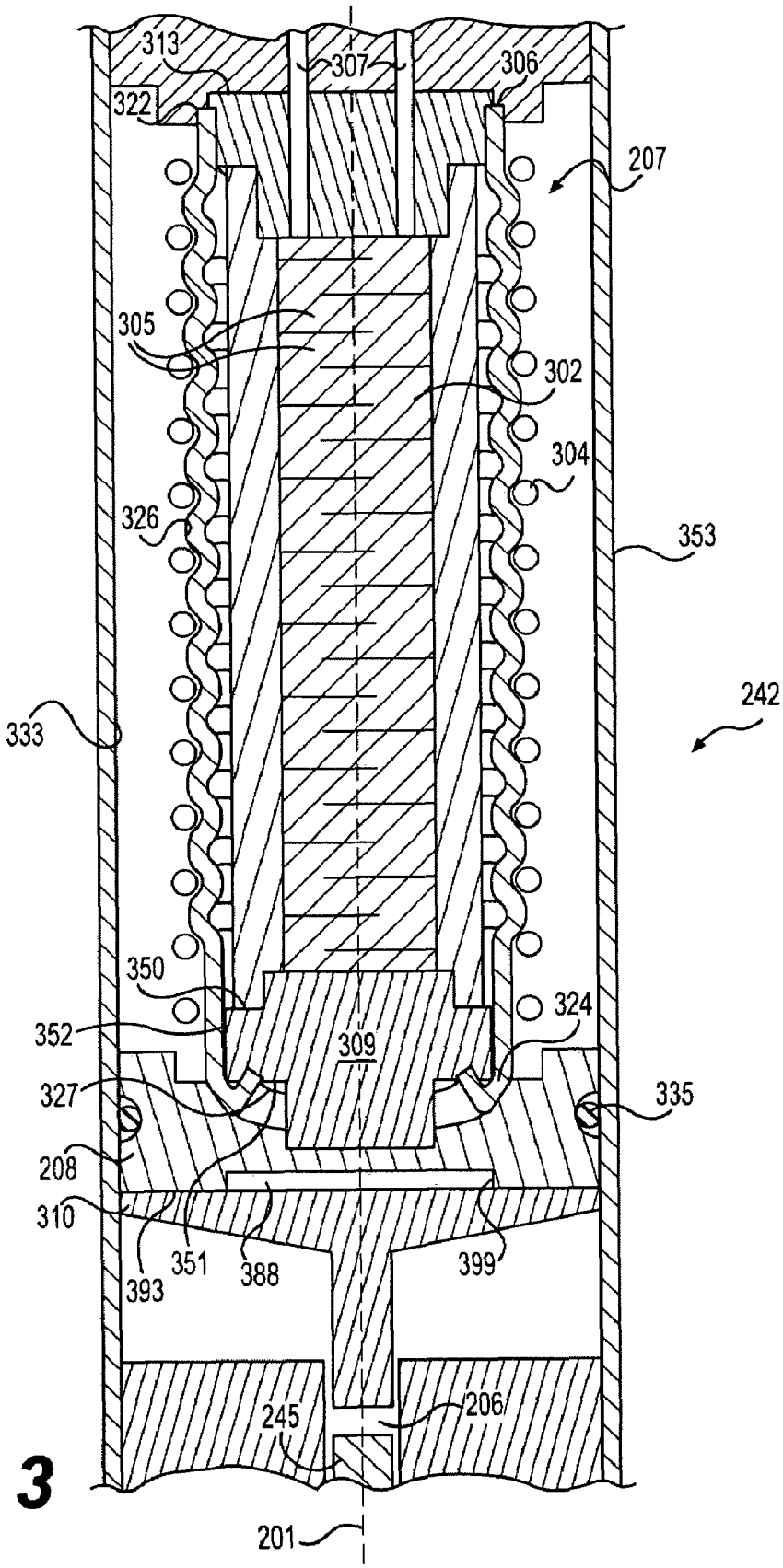
FIG. 3 is a diagrammatic illustration of an exemplary piezo actuator for use with the fuel injector of FIG. 2.

Turning now to FIG. 3, actuation assembly 242 may include various components including, hermetically sealed assembly 207, a preload spring 304, engagement device 208, and motion coupler 310. Additionally, hermetically sealed assembly 207 may include an inner casing 306, a first end cap 309, a second end cap 313, a pair of electrical contacts 307 and a piezoelectric stack 302. Hermetically sealed assembly 207 may be preloaded by preload spring 304. However, it is contemplated that preload spring 304 may be omitted and the function of preloading hermetically sealed assembly 207 may be alternatively performed by inner casing 306, first end cap 309 and second end cap 313, if desired. Additionally, hermetically sealed assembly 207 may contact engagement device 208 and, likewise, engagement device 208 may contact motion coupler 310.

Inner casing 306 may house piezoelectric stack 302 and may provide protection against environmental hazards (e.g., fuel contamination, physical damage, etc.). Inner casing 306 may include a generally cylindrical wall portion 322 and an end portion 324. Wall portion 322 may include a plurality of alternating large and small diameters that together form a bellows 326. In one example, bellows 326 may extend along inner casing 306 about the same length as piezoelectric stack or element 302, when assembled, to accommodate the expansion and retraction described above. End portion 324 may be integral to wall portion 322, formed of the same material, and bent inward from wall portion 322 toward a central axis 201. In one example, end portion 324 may be bent inward through an angle greater than 90 degrees for engagement with first end cap 309.

Wall portion 322 and end portion 324 may be formed through a deep draw process. Specifically, a metallic blank (not shown) such as, for example, an aluminum blank, may be forced against a mold (e.g., into a female mold or over a male mold) to form a substantially cylindrical-shaped object having an open end and a closed end. In the particular example depicted in FIG. 3, the aluminum blank was forced into a female mold such that end portion 324 was bent through the appropriate angle described above. Once the cylindrical-shaped object is formed, a hole 327 having a diameter less than an inner diameter of wall portion 322 may be made through the closed end of the cylindrical-shaped object, such that only an annular lip structure remains. Hole 327 may be made through a shearing process, reaming process, boring process, or any another known hole-making process. It is contemplated that wall portion 322 and end portion 324 may alternatively be formed from a metal blank other than aluminum such as, for example, from stainless steel, if desired.

Bellows 326 may be formed within wall portion 322 through a thread-rolling process. In particular, the cylindrical-shaped object described above may be mounted within a machine to rotate or otherwise be spun about its central axis. During this rotation, one or more dies having a plurality of equally spaced, ridge-shaped protrusions may be urged into an outer and/or inner surface of the inner casing 306, thereby deforming the surface to create bellows 326 within inner casing 306.

First end cap 309 may be operatively connected to piezoelectric stack 302. First end cap 309 may be connected to piezoelectric stack 302 to transfer a loading force associated with the expansion and contraction of piezoelectric stack 302 to engagement device 208. To withstand the loading force generated by the expansion of piezoelectric stack 302 and the chemical environment within actuation assembly 242, first end cap 309 may be fabricated from, for example, stainless steel.

To minimize the likelihood of fuel leaking into and contaminating piezoelectric stack 302, first end cap 309 may be hermetically sealed to inner casing 306. Specifically, first end cap 309 may include an inner face 350, an outer face 351, and a cylindrical surface 352 connecting inner and outer faces 350 and 351. Outer face 351 and/or cylindrical surface 352 may be welded, chemically joined, or otherwise sealed to wall portion 322 and/or end portion 324, respectively. It is contemplated that multiple sealing locations between inner casing 306 and first end cap 309 may provide improved leakage protection for piezoelectric stack 302, as compared to a single sealing location.

Similar to first end cap 309, a second end cap 313 may likewise be connected to piezoelectric stack 302 and hermetically sealed to inner casing 306. Second end cap 313 may be connected to an end of piezoelectric stack 302 opposing first end cap 309 to transfer the loading force associated with the expansion and contraction of piezoelectric stack 302 in reverse direction to a support of fuel injector 132 (referring to FIG. 2). To withstand the loading force generated by the expansion of piezoelectric stack 302 and the chemical environment within actuation assembly 242, second end cap 313 may also be fabricated from stainless steel. An outer cylindrical housing 353 of second end cap 313 may be welded, chemically joined, or otherwise sealed to wall portion 322.

Piezoelectric stack 302 may consist of multiple layers 305 of a piezoelectric material separated by a pair of electrical contacts 307. The layers 305 may be square, cylindrical, or disk shaped in cross section and may be formed from various crystals, ceramics, or polymers. As used herein, piezoelectric material refers to any material exhibiting an inverse piezoelectric effect. That is, any material that changes shape when exposed to an electric potential. For example, some materials exhibiting the inverse piezoelectric effect are lead zirconate titanate, barium titanate, potassium niobate, lithium tantalate, and sodium tungstate. The most common of these materials for use with piezoelectric actuators may be lead zirconate titanate, also referred to as PZT.

Materials exhibiting the inverse piezoelectric effect may have dipoles, that is, they may have domains containing negative and positive charges that may be segregated from each other. In some piezoelectric materials, such as, for example, quartz, the orientation of dipoles may be random. In other materials such as, for example, lead zirconate titanate, these dipoles may be aligned. Additionally, dipoles within lead zirconate titanate may be aligned using a process called polling. Polling may employ a magnetic field to force the dipoles into alignment, a process which may increase the inverse piezoelectric effect.

Piezoelectric stack 302 may take advantage of the inverse piezoelectric effect to convert electrical energy into kinetic energy. That is, piezoelectric stack 302 may, when energized, expand to cause the change in displacement within fuel injector 132. It is contemplated that an electrical potential of about 160 volts may be applied to the piezoelectric stack 302. However, this value may vary, and may be between 0 and 500 volts.

Electrical contacts 307 may embody positive and negative conductors that extend through second end cap 313 to direct electrical energy into and out of piezoelectric stack 302. Electrical contacts 307 may connect to electrical terminal 250 on one end and may be alternatingly connected to layers 305 of piezoelectric stack 302 on the other. When the voltage is applied to the electrical contacts 307, an electric field may exert a torque on the dipoles thereby causing the layer to extend in length. The change in length may be proportional to the applied voltage and, therefore, may allow for precise position control of upper piston 245. It is contemplated that, in addition to the applied voltage, the change in length of piezoelectric stack 302 may also be proportional to a quantity of layers 305.

Piezoelectric materials such as, for example, PZT may be brittle and may be able to withstand relatively little torque, tension, and shear force. To protect the piezoelectric materials from mechanical damage it may be beneficial to isolate these undesirable forces from piezoelectric stack 302. Isolation may be accomplished by various isolation components such as, for example, preload spring 304. Tensioning spring 304 may be configured to provide a preload across piezoelectric stack 302. The preload provided by preload spring 304 may be about twenty percent of the compressive load limit or may be 150 to 1500 Newtons and may prevent a pulling force from damaging one or more layers 305. Further, first end cap 309 and second end cap 313 may work in conjunction with inner casing 306 to further isolate the piezoelectric stack 302 from undesired forces. In particular, first end cap 309, second end cap 313, inner casing 306, and bellows 326 may work together to isolate the piezoelectric stack 302 from bending forces and shear forces.

Engagement device 208 may be slidably disposed within actuator bore 333 and may abut first end cap 309 and motion coupler 310. Engagement device 208 may be aligned with the central axis 201, and may be configured to transmit the loading force generated by piezoelectric stack 302 to motion coupler 310. It is contemplated that engagement device 208 may be configured to transmit the displacement created by piezoelectric stack 302 to motion coupler 310. It is further contemplated that, engagement device 208 may also further isolate piezoelectric stack 302 from torque, tension, and shear forces.

A seal 335 may be disposed between engagement device 208 and actuator bore 333. Seal 335 may be an o-ring and may block fuel from inner casing 306. Alternatively, it is contemplated that seal 335 may be omitted and that a diaphragm may be used in its place to block the flow of fuel from inner casing 306 and piezoelectric stack 302.

In the embodiment shown in FIG. 3, engagement device 208 includes an annular protrusion 399 that interfaces with motion coupler 310. Annular protrusion 399 may focus the loading force generated by piezoelectric stack 302 to a reduced area of motion coupler 310. That is, annular protrusion 399 may distribute the loading force transmitted to engagement device 208 from piezoelectric stack 302 to an outer radial portion 393 of motion coupler 310. Annular protrusion 399 may form a void 388 when engaged with motion coupler 310. Void 388 may be situated in line with central axis 201 adjacent to piezoelectric stack 302. It is contemplated that annular protrusion 399 may be omitted and engagement device 208 may interface with motion coupler 310 across the entire surface or that annular protrusion 399 may be separate from motion coupler 310. It is further contemplated that engagement device 208 may be omitted completely and that actuation assembly 242 may interface directly with motion coupler 310.

Motion coupler 310 may protect and isolate piezoelectric stack 302 from shock by absorbing excess motion. As used herein shock may refer to a sudden impact that occurs when piezoelectric stack 302 hits a dead stop. Shock within a brittle material such as the piezoelectric crystal may cause microscopic fractures within the crystal. Over time these microscopic fractures may cause failure. It is contemplated that shock may be reduced within piezoelectric stack 302 by reducing or preventing the piezoelectric stack 302 from hitting the dead stop. Motion coupler 310 may be configured to bend or deform to absorb excess motion and allow piezoelectric stack 302 to decelerate over a deceleration time and a deceleration distance, rather than decelerating rapidly. It is contemplated that, in one embodiment, motion coupler 310 may be fabricated from steel or any other material apparent to one skilled in the art to absorb excess motion. If piezoelectric stack 302 is allowed to decelerate rapidly, microscopic fractures may form within the brittle crystalline structure of the piezoelectric material in the piezoelectric stack 302. Over time, and after repeatedly hitting the dead stop, piezoelectric stack 302 may experience fatigue failure thereby reducing durability and lifetime of fuel injector 132.

Referring to FIG. 2 and FIG. 3, it is contemplated that motion coupler 310 may receive the loading force caused by piezoelectric stack 302. The loading force and a first distance may be transmitted to motion coupler 310 by engagement device 208 as piezoelectric stack 302 expands. In reaction to the loading force, motion coupler 310 may translate along central axis 201 and away from piezoelectric stack 302 until connecting with upper piston 245. Upon connecting with upper piston 245, both upper piston 245 and motion coupler 310 may move together along central axis 201 and away from piezoelectric stack 302 until control element 289 is displaced from an upper seat 227 by tip 223. Upon displacing control element 289, that is, after piezoelectric stack 302 has expanded causing a translation of a second distance, control element 289 may hit a dead stop. That is, upper piston 245 and control element 289 may travel a second distance and then control element 289 may hit the dead stop. It is contemplated, that this distance may include the width of gap 206. Upon hitting the dead stop, motion coupler 310 may begin to deflect so that piezoelectric stack 302 may continue to expand and the first distance may continue to increase. To facilitate deflection, motion coupler 310 may be constructed of a ductile material. able to elastically deform. It is further contemplated that motion coupler 310 may protect and isolate piezoelectric stack 302 from damage by absorbing an excess motion created by piezoelectric stack 302. The excess motion absorbed by motion coupler 310 may be equal to the difference between the first distance and the second distance.

Figure 4:
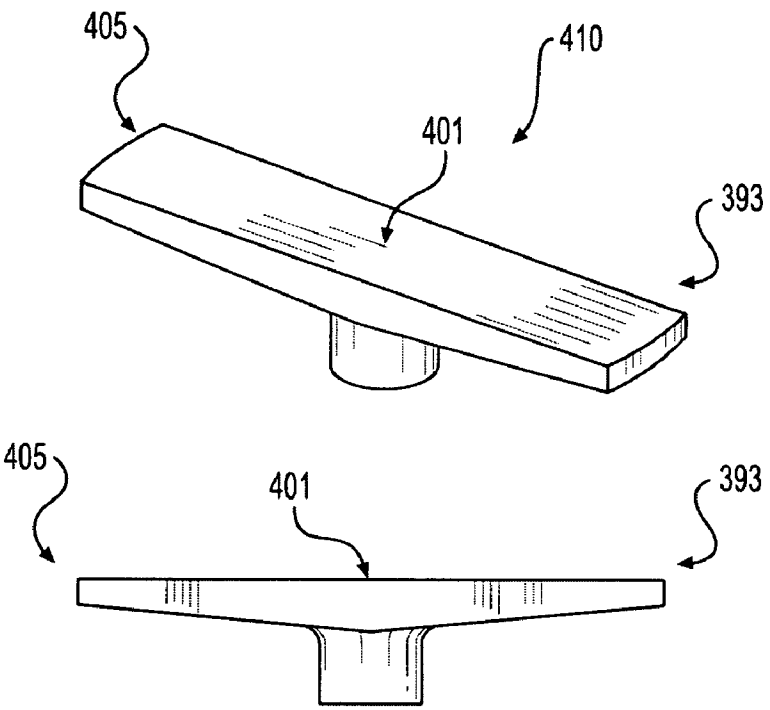
FIG. 4 is a diagrammatic illustration of an exemplary two arm motion coupler for use with the fuel injector of FIG. 2.

Referring now to FIG. 4, a first embodiment of motion coupler 310 is shown. In this embodiment, motion coupler 410 may have two arms 405. Each arm 405 may extend outward from a hub 401 toward the outer radial portion 393. That is, each arm 405 may extend from hub 401 to cylindrical housing 353 (FIG. 3) and/or may be as wide as engagement device 208. Each arm 405 may be configured to deflect under the loading force caused by piezoelectric stack 302. That is, a bending moment may be created within each arm to allow expansion of piezoelectric stack 302 after motion coupler 310 has hit the dead stop.

Figure 5:
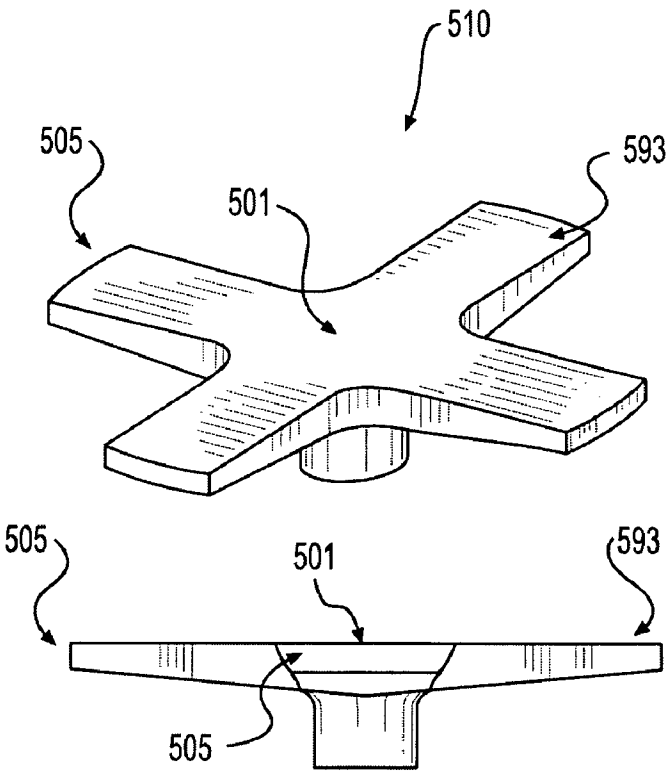
FIG. 5 is a diagrammatic illustration of an exemplary four arm motion coupler for use with the fuel injector of FIG. 2.

Referring now to FIG. 5, a second embodiment of motion coupler 310 is shown. In this embodiment, motion coupler 510 may have four arms 505. Each arm 505 may extend outward from a hub 501 toward an outer radial portion 593. That is, each arm 505 may extend from hub 501 to cylindrical housing 353 (FIG. 3) and/or may be as wide as engagement device 208. Each arm 505 may be configured to deflect under the loading force caused by piezoelectric stack 302. That is, a bending moment may be created within each arm to allow expansion of piezoelectric stack 302 after motion coupler 310 has hit the dead stop.

It is further contemplated that motion coupler 310 may be omitted completely and that upper piston 245 may protect and isolate piezoelectric stack 302 from shock by absorbing excess motion. Upper piston 245 may be constructed of various materials and may have a geometry necessary to absorb excess motion by deforming along its length. That is, upper piston 245 may be constructed with a geometry and/or material to allow a change in length of the piston sufficient to absorb a distance equal to the difference between the first distance and the second distance. For example, upper piston 245 may be cylindrical and may be constructed of various types of steel, aluminum, titanium, or any other material apparent to one skilled in the art.

As one skilled in the art will recognize, in addition to the embodiments shown in FIG. 4 and FIG. 5, many other embodiments may be possible. For example, it is contemplated that motion coupler 310 may be connected to upper piston 245 and that gap 206 may be omitted. Additionally, it is contemplated that engagement device 208 may be connected to motion coupler 310. Alternatively, motion coupler 310 may be disposed within bellows 326 and/or may directly contact piezoelectric stack 302. It is further contemplated that arms 405, 505 may be omitted and/or motion coupler 310 may have a circular interface with engagement device 208. In these embodiments, motion coupler 310 may be configured to have a bending moment, allowing for piezoelectric stack 302 to expand when energized, thereby reducing wear and microscopic fractures that may cause fuel injector 132 to fail.

INDUSTRIAL APPLICABILITY

Although illustrated and described above as being utilized in conjunction with a fuel injector, the disclosed motion coupler 310 may be applicable to any application of a piezoelectric actuator where the piezoelectric stack may hit a hard stop. By absorbing excess motion of the piezoelectric stack 302, the disclosed motion coupler 310 may reduce shock within the piezoelectric stack 302 and thereby reduce microscopic fractures that may lead to fatigue. This reduction in microscopic fractures from shock may extend the lifetime and durability of fuel injector 132. The operation of exemplary power system 100 will now be explained.

Fuel at a first pressure within tank 124 may be pressurized to a second pressure by low pressure pump 126 and from a second pressure to a third pressure by high pressure pump 136. Pressurized fuel from high pressure pump 136 may be delivered to injection manifold 134 through check valve 128 and fuel line 130. From injection manifold 134, pressurized fuel may be delivered to fuel inlet port 221 of fuel injector 132 through fuel line 166.

From fuel inlet port 212, pressurized fuel may flow through upper passageway 235 and lower passageway 236 to fill control chamber 286. Additionally, pressurized fuel may flow through control orifice 283 to fill check top volume 285, balance orifice 281, and internal bore 229. The pressurized fuel within internal bore 229 may force control element 289 to settle against upper seat 227, thereby blocking the pressurized fuel from flowing into drain passageway 256. Likewise, pressurized fuel may act on first hydraulic surface 279 to cause needle valve element 278 to settle against needle valve element seating surface 294, thereby blocking the pressurized fuel from flowing into combustion chamber 110 through injection orifice 187.

To deliver the injection of pressurized fuel to combustion chamber 110 piezoelectric stack 302 may be expanded by passing electrical energy through electrical terminal 250. Electrical energy applied to electrical terminal 250 may energize piezoelectric stack 302 by way of electrical contacts 307 disposed between layers 305 of piezoelectric material. Upon being energized, layers 305 may individually expand to cause displacement within hermetically sealed assembly 207. For example, piezoelectric stack 302 may be energized with 260 volts causing hermetically sealed assembly 207 to expand in length along central axis 201. The expansion may force engagement device 208 to translate the first distance along the central axis 201 toward control valve 251. For example, in one embodiment, the first distance may be 40 microns. Because motion coupler 310 is in contact with engagement device 208 at outer radial portion 393, motion coupler 310 may also translate toward control valve 251. Upon contact with upper piston 245, motion coupler 310 and upper piston 245 may translate together to push control element 289 off of its upper seat 227 with tip 223.

When control element 289 is pushed off of upper seat 227 by tip 223, check top volume 285, balance orifice 281, and internal bore 229 may rapidly depressurize into drain passageway 256. Depressurization of check top volume 285 may change the bias of needle valve element 278. That is, pressurized fuel within control chamber 286 may act on second hydraulic surface 280 causing the needle valve element 278 to move away from needle valve element seating surface 294, thereby unblocking injection orifice 287. With injection orifice 287 unblocked, injections of pressurized fuel may be delivered from control chamber 286 into combustion chamber 110.

Soon after pushing control element 289 off of upper seat 227, motion coupler 310 may be restricted from further movement. For the purposes of this example only, this may occur after piezoelectric stack 302 has expanded the second distance. In one exemplary embodiment, the second distance may be 25 microns. Since piezoelectric stack 302 will continue to expand until reaching the first distance, motion coupler 310 may absorb the excess motion to reduce the shock of a hard stop to piezoelectric stack 302. That is, motion coupler 310 may deflect a distance equal to the first distance minus the second distance to reduce shock within piezoelectric stack 302.

Arms 405 of motion coupler 310 may deflect to absorb the excess motion caused by the expansion of piezoelectric stack 302. By deflecting, the arms 405 may decrease the rate at which piezoelectric stack 302 decelerates, thereby reducing shock. Since shock may cause microscopic cracks within the piezoelectric material that may lead to failure by fatigue, reducing shock may extend the lifetime of fuel injector 132 and increase its durability.

It will be apparent to those skilled in the art that various modifications and variations can be made to the fuel injector of the present disclosure without departing from the scope of the disclosure. Other modifications will be apparent to those skilled in the art from consideration of the specification and practice of the fuel injector as disclosed herein. It is intended that the specification and examples be considered as exemplary only, with a true scope of the disclosure being indicated by the following claims and their equivalents.

What is claimed is:

1. A fuel injector, comprising:

a casing substantially aligned along a central axis of the fuel injector;

a control valve configured to control a flow of fuel through the fuel injector, the control valve including a control element movable within an internal bore to a dead stop which limits travel of the control element;

a piezoelectric element disposed within the casing and mechanically coupled to the control valve, the piezoelectric element configured to expand a first distance along the central axis, a portion of that first distance after which the control element engages the dead stop being excess motion; and a motion coupler mechanically coupled between the control element and the piezoelectric element, the motion coupler configured to absorb the excess motion of the piezoelectric element, thereby to reduce shock within the piezoelectric element.

2. The fuel injector of claim 1, further including an engagement device connected to the piezoelectric element, the engagement device configured to distribute a loading force from the piezoelectric element through an annular protrusion to the motion coupler.

3. The fuel injector of claim 2, wherein the loading force from the piezoelectric element is distributed by the annular protrusion to an outer radial portion of the motion coupler, the outer radial portion configured to deflect toward the control valve.

4. The fuel injector of claim 1, wherein the motion coupler has four arms, each arm extending outward from a hub toward the casing and configured to bend to reduce shock within the piezoelectric element.

5. The fuel injector of claim 1, wherein the motion coupler has at least two arms, each arm extending outward from the central axis toward the casing and configured to bend to reduce shock within the piezoelectric element.

6. The fuel injector of claim 1, further including an engagement device connected to the piezoelectric element, the engagement device having an annular protrusion arranged in alignment with the central axis and configured to engage the motion coupler.

7. The fuel injector of claim 6, wherein an interface between the engagement device and the motion coupler includes a void, the void being substantially in line with the piezoelectric element along the central axis.

8. The fuel injector of claim 1, further including a piston disposed between the control valve and the piezoelectric element, the piston configured to reduce shock within the piezoelectric element.

9. The fuel injector of claim 8, wherein the motion coupler is connected to the piston, such that the motion coupler and piston move together.

10. The fuel injector of claim 1, in which the control element is configured to move a second distance that is not equal to the first distance, wherein the first distance is approximately equal to a sum of the second distance and a deflection of the motion coupler.

11. A fuel injector, comprising:

a casing substantially aligned along a central axis of the fuel injector;

a piezoelectric element disposed within the casing and configured to expand a first distance along the central axis;

a control element disposed along the central axis, the control element configured to move a second distance and affect a flow of fuel through the fuel injector, the second distance not equal to the first distance; and a piston slidably disposed between the piezoelectric element and the control element, the piston configured to transfer motion from the piezoelectric element to the control element.

12. The fuel injector of claim 11, wherein the first distance is approximately equal to a sum of the second distance and a change in length of the piston.

13. The fuel injector of claim 11, wherein the piston is configured to reduce shock within the piezoelectric element.

14. The fuel injector of claim 11, further including a motion coupler disposed between the piston and the piezoelectric element, the motion coupler configured to reduce shock within the piezoelectric element.

15. A method of injecting fuel, comprising:

pressurizing fuel;

selectively energizing a piezoelectric element to translate a first distance;

absorbing a portion of the first distance and reducing shock within the piezoelectric element; and translating a piston a second distance to affect a flow of pressurized fuel to be injected, the second distance having a magnitude that is less than the magnitude of the first distance.

16. The method of claim 15, further including providing a motion coupler that traverses a gap by moving the first distance, the gap configured to reduce stress associated with temperature variations.

17. The method of claim 15, further including directing a loading force caused by the piezoelectric element to an outer radial portion of a motion coupler to increase deflection and to reduce shock within the piezoelectric element.

18. The method of claim 15, wherein selectively energizing the piezoelectric element includes expanding the piezoelectric element after pressurized fuel is injected.

19. A power system, comprising:

an engine;

a pump fluidly connected to the engine and configured to pressurize fuel;

a fuel injector disposed between the pump and the engine, the fuel injector configured to receive a pressurized fuel from the pump and to deliver an injection of the pressurized fuel to the engine;

a piezoelectric element disposed within the fuel injector and movable a first distance; and a motion coupler coupled to the piezoelectric element, the motion coupler configured to move a second distance, the second distance having a magnitude less than the magnitude of the first distance.

20. The power system of claim 19, further including a control element movable to control the injection of the pressurized fuel from the pump to the engine, the control element coupled to the motion coupler and configured to move the second distance.

21. The power system of claim 20, further including:

an upper piston slidably disposed between the control element and the motion coupler, the upper piston configured to actuate the control element;

an actuator piston disposed between the piezoelectric element and the motion coupler; and an annular protrusion connected to the actuator piston, the annular protrusion configured to distribute a loading force created by the piezoelectric element to an outer radial portion of the motion coupler.

22. The power system of claim 19, wherein the motion coupler has a plurality of arms configured radially from a center of the motion coupler, the plurality of arms configured to deflect as a function of a difference between the first distance and the second distance.

* * * * *